US009541278B2

(12) United States Patent
Wang

(10) Patent No.: US 9,541,278 B2
(45) Date of Patent: Jan. 10, 2017

(54) CEILING FAN STRUCTURE WITH LED LAMP

(71) Applicant: YOUNGO LIMITED, Hong Kong (CN)

(72) Inventor: Cliff Wang, Taichung (TW)

(73) Assignee: YOUNGO LIMITED, Hong Kong (CN)

( * ) Notice: Subject to any disclaimer, the term of this patent is extended or adjusted under 35 U.S.C. 154(b) by 102 days.

(21) Appl. No.: 14/736,965

(22) Filed: Jun. 11, 2015

(65) Prior Publication Data

US 2016/0363313 A1 Dec. 15, 2016

(51) Int. Cl.

| | |
|---|---|
| ***F21V 33/00*** | (2006.01) |
| ***F21V 1/12*** | (2006.01) |
| ***F21V 19/00*** | (2006.01) |
| ***F21V 11/14*** | (2006.01) |
| ***F04D 25/08*** | (2006.01) |
| ***F04D 29/32*** | (2006.01) |
| ***F04D 25/06*** | (2006.01) |
| *F21Y 101/02* | (2006.01) |

(52) U.S. Cl.

CPC ..... *F21V 33/0096* (2013.01); *F04D 25/06* (2013.01); *F04D 25/088* (2013.01); *F04D 29/325* (2013.01); *F21V 1/12* (2013.01); *F21V 11/14* (2013.01); *F21V 19/0055* (2013.01); *F21Y 2101/02* (2013.01)

(58) Field of Classification Search

None

See application file for complete search history.

(56) References Cited

U.S. PATENT DOCUMENTS

| | | | | |
|---|---|---|---|---|
| 6,265,984 | B1 * | 7/2001 | Molinaroli | A63H 33/40 340/815.4 |
| 2015/0086363 | A1 * | 3/2015 | Graziano | F04D 29/005 416/5 |
| 2016/0169503 | A1 * | 6/2016 | Chen | F21K 9/20 416/5 |

* cited by examiner

*Primary Examiner* — Ashok Patel

(74) *Attorney, Agent, or Firm* — Ming Chow; Sinorica, LLC

(57) ABSTRACT

A ceiling fan structure with an LED lamp includes a ceiling fan main body. An annular lampshade is disposed around the periphery of the fan. The annular lampshade has an annular accommodation space therein. The top of the annular lampshade is formed with an opening corresponding to the accommodation space. Two LED lamp boards are longitudinally disposed in the accommodation space. The opening is provided with a lid. The LED lamp boards of the present invention have a better heat dissipation effect. When in use, the locking parts won't be seen from the bottom of the annular lampshade. The present invention has the advantages of convenient replacement and pleasing appearance.

8 Claims, 9 Drawing Sheets

CEILING FAN STRUCTURE WITH LED LAMP

BACKGROUND OF THE INVENTION

1. Field of the Invention

The present invention relates to a ceiling fan structure, and more particularly to a ceiling fan structure with an LED lamp.

2. Description of the Prior Art

FIG. 1 is an exploded view of a conventional ceiling fan. FIG. 2 is a partial sectional view of the conventional ceiling fan. The conventional ceiling fan has a ceiling fan main body 1. The lower end of the ceiling fan main body 1 is connected with a lamp holder 2. The bottom of the lamp holder 2 is connected with a disc 4 through a plurality of screws 3. The bottom of the disc 4 is connected with a lamp plate 5 through a plurality of screws 3. The lamp plate 5 is provided with light emitting diodes 6 thereon. The disc 4 is further connected with a lampshade 7 through a plurality of screws 3. When the user turns on the ceiling fan to lower the indoor temperate, the LEDs 6 can be activated to provide an illumination effect at the same time.

However, the aforesaid ceiling fan has the shortcomings described hereinafter. In the conventional ceiling fan, the way to secure the lampshade 7 to the disc 4 and the way to secure the disc 4 to the lamp holder 2 use the screws 3 to lock the lampshade 7 and the disc 4 to the lamp holder 4 from bottom to top. The heads of the screws 3 are exposed out of the bottom of the lamp holder 2. When the user raises his/her head, the exposed screw heads are seen. This results in that the appearance of the ceiling fan is not pleasing.

Accordingly, the inventor of the present invention has devoted himself based on his many years of practical experiences to solve these problems.

SUMMARY OF THE INVENTION

The primary object of the present invention is to provide a ceiling fan structure with an LED lamp, which is assembled from top to bottom so that the present invention has a pleasing appearance.

In order to achieve the aforesaid object, the ceiling fan structure with an LED lamp of the present invention comprises a ceiling fan main body, an annular lampshade, at least one LED lamp board, and at least one lid. The ceiling fan main body has a hanging bracket. A lower end of the hanging bracket is connected with a hanging rod. A free end of the hanging rod is connected with a motor. A lower end of the motor is connected with a fan. The annular lampshade has an inner annular wall around the periphery of the fan, an outer annular wall parallel to the inner annular wall, a bottom wall connected between the inner annular wall and the outer annular wall, an accommodation space defined among the inner annular wall, the outer annular wall and the bottom wall, and an opening formed on a top of the annular lampshade. The LED lamp board is longitudinally disposed in the accommodation space. The LED lamp board has a curved shape corresponding to the annular lampshade. Two opposing sides of the LED lamp board keep an interval relative to the inner annular wall and the outer annular wall, respectively. The lid is disposed at the opening.

The ceiling fan structure of the present invention enables the LED lamp board to have a better heat dissipation effect through the LED lamp board longitudinally disposed in the accommodation space of the annular lampshade from the opening as well as the lid locked to the annular lampshade from the top of the annular lampshade. When in use, the locking parts won't be seen from the bottom of the annular lampshade. The present invention has the advantages of convenient replacement and pleasing appearance.

DETAILED DESCRIPTION OF THE PREFERRED EMBODIMENTS

Embodiments of the present invention will now be described, by way of example only, with reference to the accompanying drawings.

Figure 1:
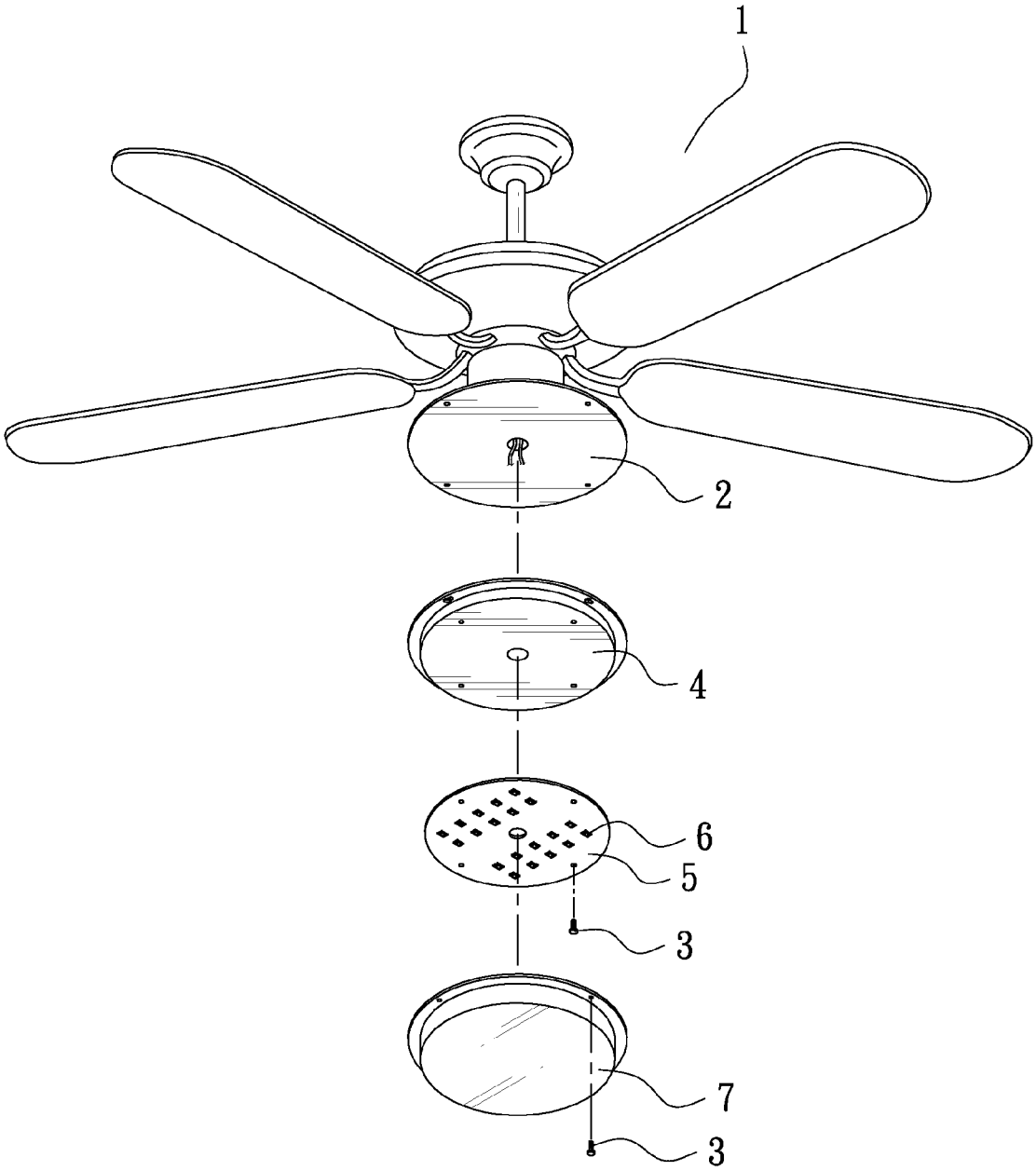
FIG. 1 PRIOR ART
FIG. 1 is an exploded view of a conventional ceiling fan.
Figure 2:
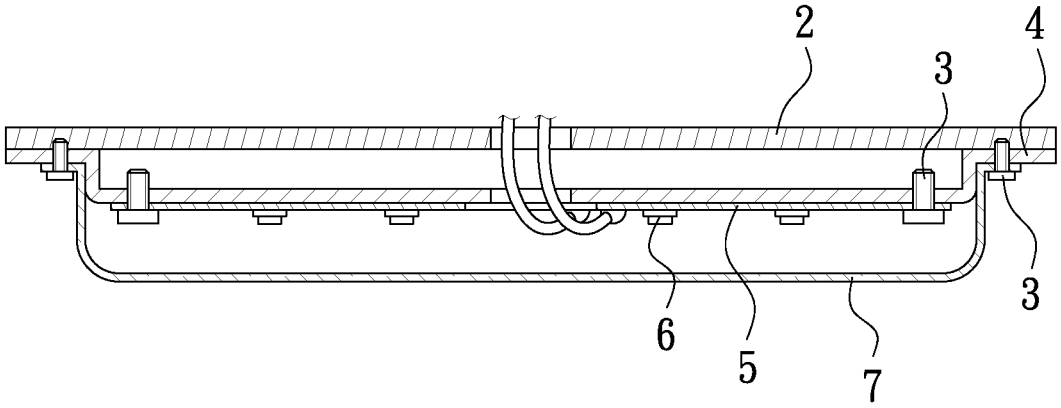
FIG. 2 PRIOR ART
FIG. 2 is a partial sectional view of the conventional ceiling fan.
Figure 3:
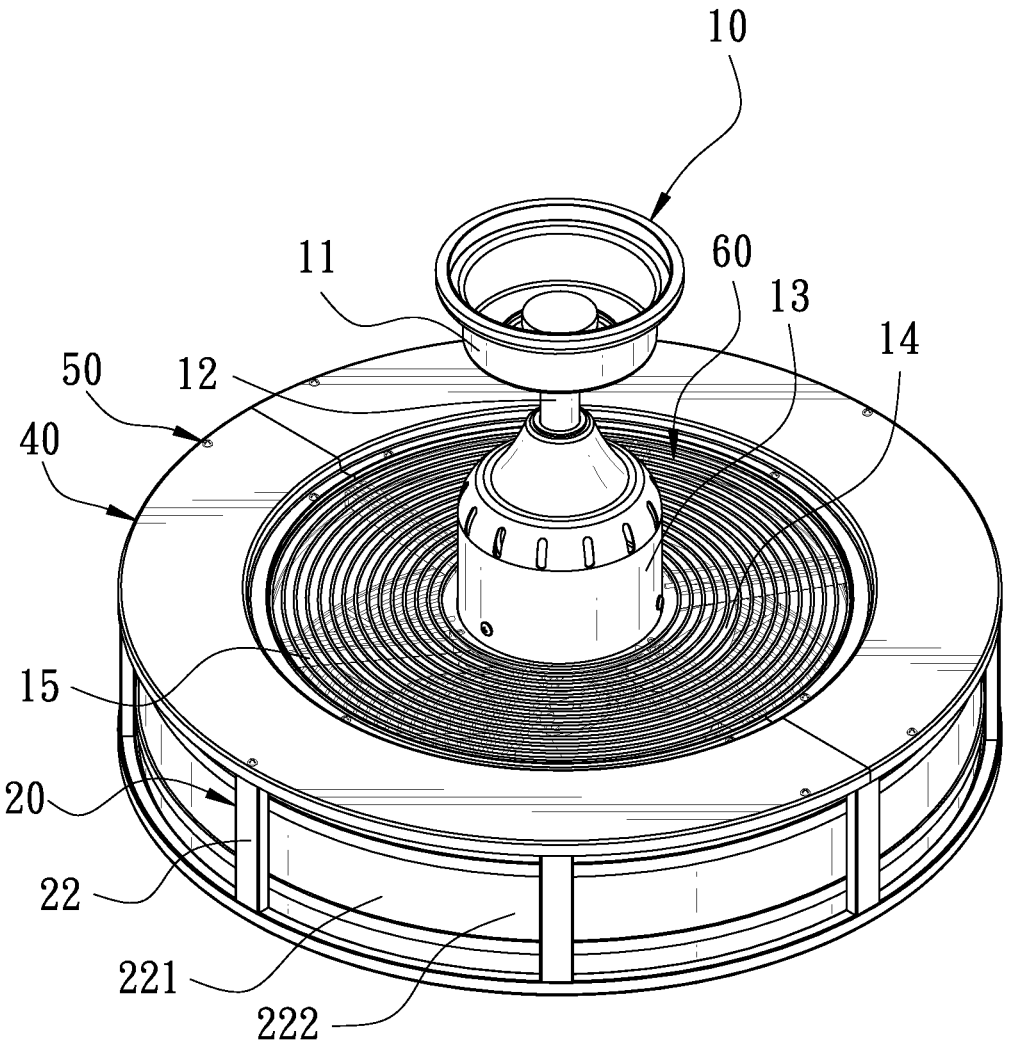
FIG. 3 is a first perspective view according to a preferred embodiment of the present invention.
Figure 4:
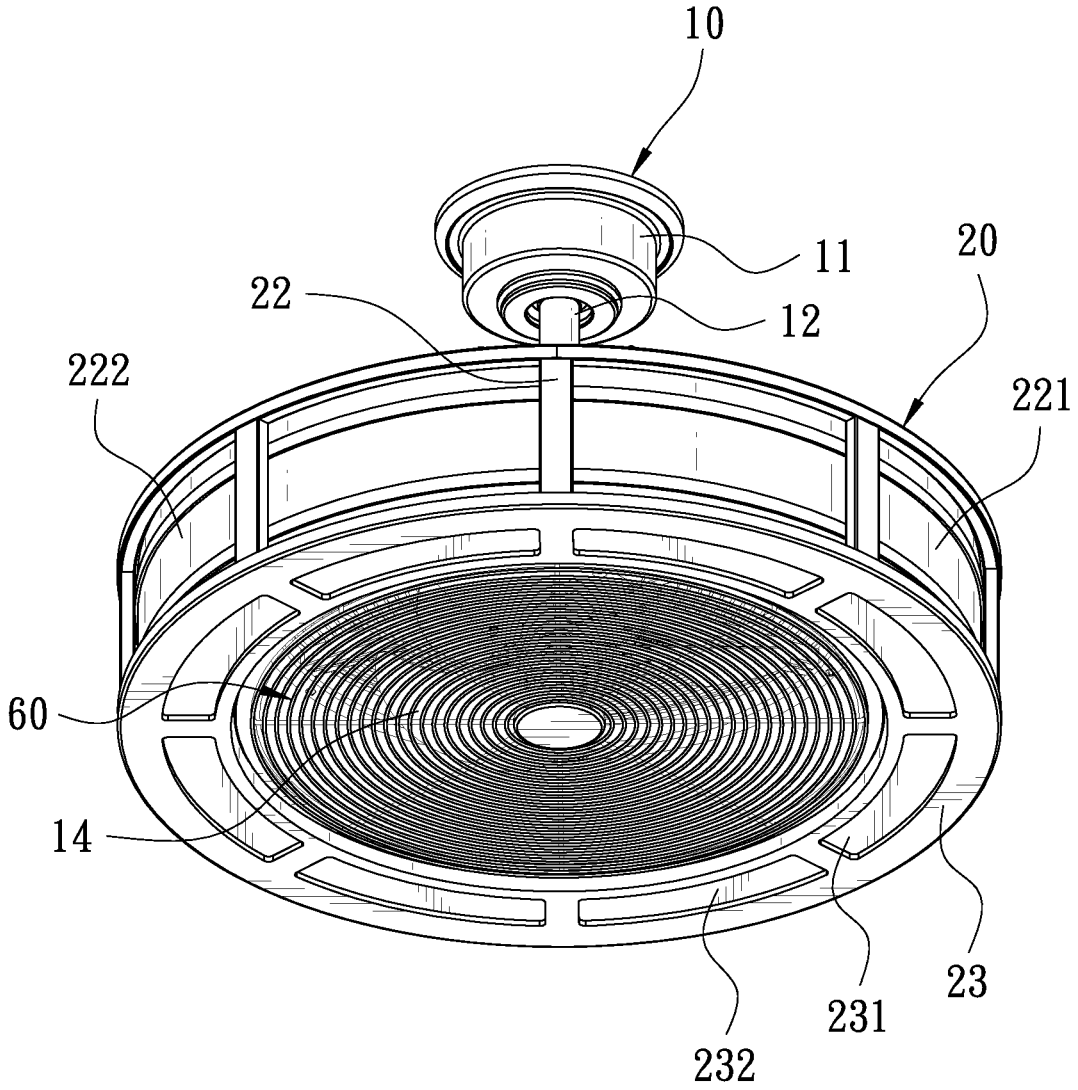
FIG. 4 is a second perspective view according to the preferred embodiment of the present invention.
Figure 5:
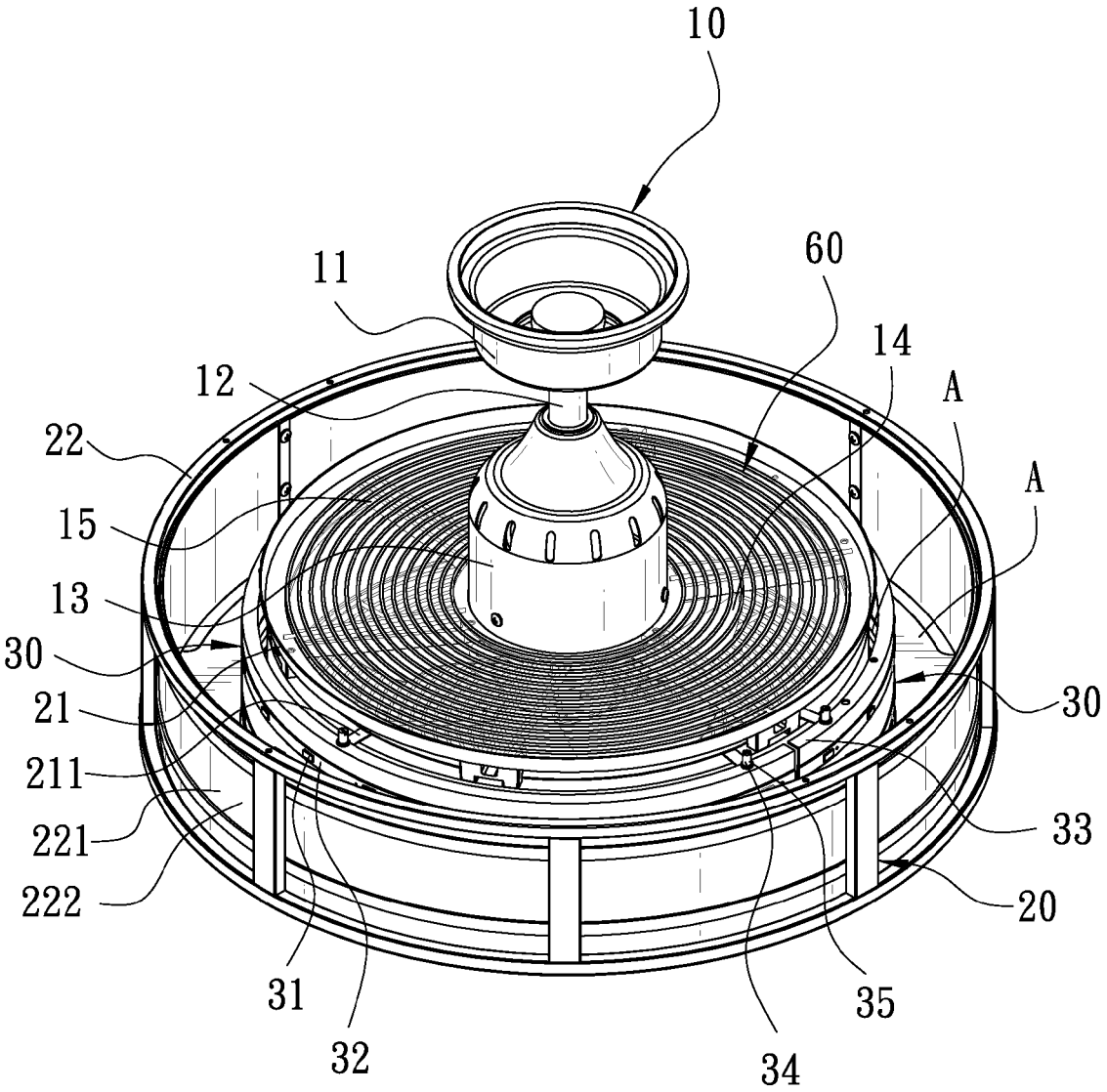
FIG. 5 is a perspective view showing the internal configuration of the preferred embodiment of the present invention.

FIG. 3 is a first perspective view according to a preferred embodiment of the present invention. FIG. 4 is a second perspective view according to the preferred embodiment of the present invention. FIG. 5 is a perspective view showing the internal configuration of the preferred embodiment of the present invention. The present invention discloses a ceiling fan structure with an LED lamp. The ceiling fan structure comprises a ceiling fan main body 10, an annular lampshade 20, at least one LED lamp board 30, at least one lid 40, and two ventilation nets 60.

The ceiling fan main body 10 has a hanging bracket 11. A lower end of the hanging bracket 11 is connected with a hanging rod 12. A free end of the hanging rod 12 is connected with a motor 13. A lower end of the motor 13 is connected with a fan 14. In this embodiment, the circumferential side of the motor 13 is provided with a plurality of connecting ribs 15 extending radially.

The annular lampshade 20 has an inner annular wall 21 around the periphery of the fan 14, an outer annular wall 22 parallel to the inner annular wall 21, a bottom wall 23 connected between the inner annular wall 21 and the outer annular wall 22, an accommodation space 24 defined among the inner annular wall 21, the outer annular wall 22 and the bottom wall 23, and an opening 25 formed on a top of the annular lampshade 20. In this embodiment, the outer annular wall 22 is provided with a plurality of spaced first light-pervious through holes 221. An inner side of the outer annular wall 22 is provided with a plurality of first light-pervious plates 222. The first light-pervious plates 222 are adapted to cover the first light-pervious through holes 221. The bottom wall 23 is provided with a plurality of spaced second light-pervious through holes 231. An inner side of the bottom wall 23 is provided with a plurality of second light-pervious plates 232. The second light-pervious plates 232 are adapted to cover the second light-pervious through holes 231. The circumferential edge of the inner annular wall 21 is provided with a plurality of locking pieces 211 extending outwardly and transversely. Another end of each connecting rib 15 is connected to the inner annular wall 21 so that the annular lampshade 20 is secured to the periphery of the fan 14.

The LED lamp board 30 is longitudinally disposed in the accommodation space 24. There are two LED lamp boards 30 in this embodiment. Each LED lamp board 30 has a curved shape corresponding to the annular lampshade 20. The LED lamp boards 30 are in a semi-circle shape to form a circle jointly. Two opposing sides of the LED lamp board 30 keep an interval A relative to the inner annular wall 21 and the outer annular wall 22, respectively. Each LED lamp board 30 is provided with a plurality of light emitting diodes 31. The light emitting diodes 31 are LED strips 32 in this embodiment. Furthermore, the circumferential edge of the LED lamp board 30 is provided with a flange 33 extending transversely toward the inner annular wall 21. Each locking piece 211 is locked to the flange 33 through a locking member 34 so that the LED lamp board 30 is secured to the annular lampshade 20. In this embodiment, the locking member 34 is a knurled-head screw 35.

The lid 40 is disposed at the opening 25. There are two lids 40 in this embodiment. Each lid 40 has a curved shape corresponding to the opening 25. The lids 40 jointly form a hollow circle. The lid 40 is locked to the inner annular wall 21 and the outer annular wall 22 of the annular lampshade 20 through a plurality of screws 50.

The two ventilation nets 60 correspond to the fan 14 and are disposed at the top and the bottom of the inner annular wall 21.

Figure 6:
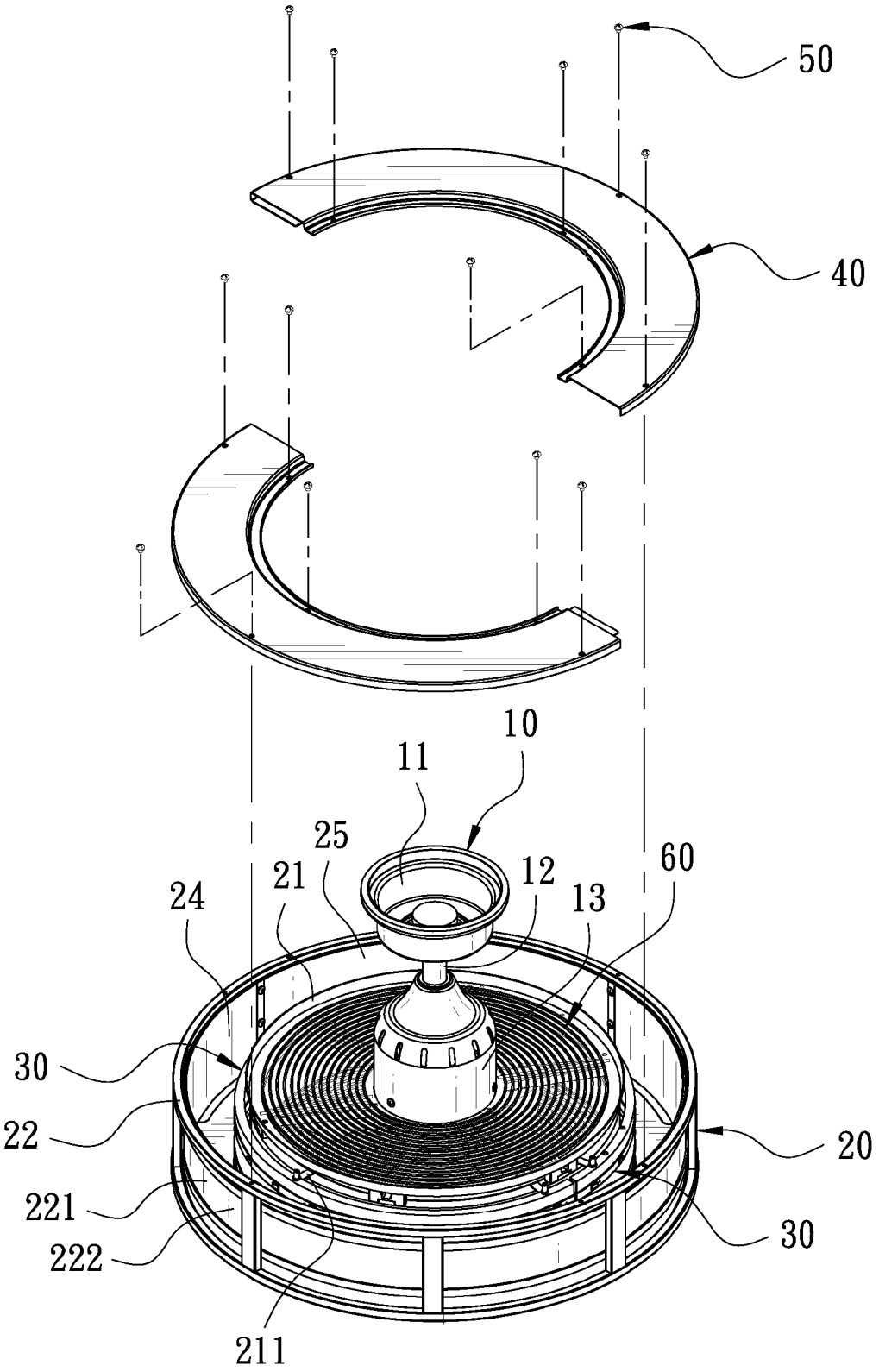
FIG. 6 is a first schematic view showing the disassembly of the preferred embodiment of the present invention.
Figure 7:
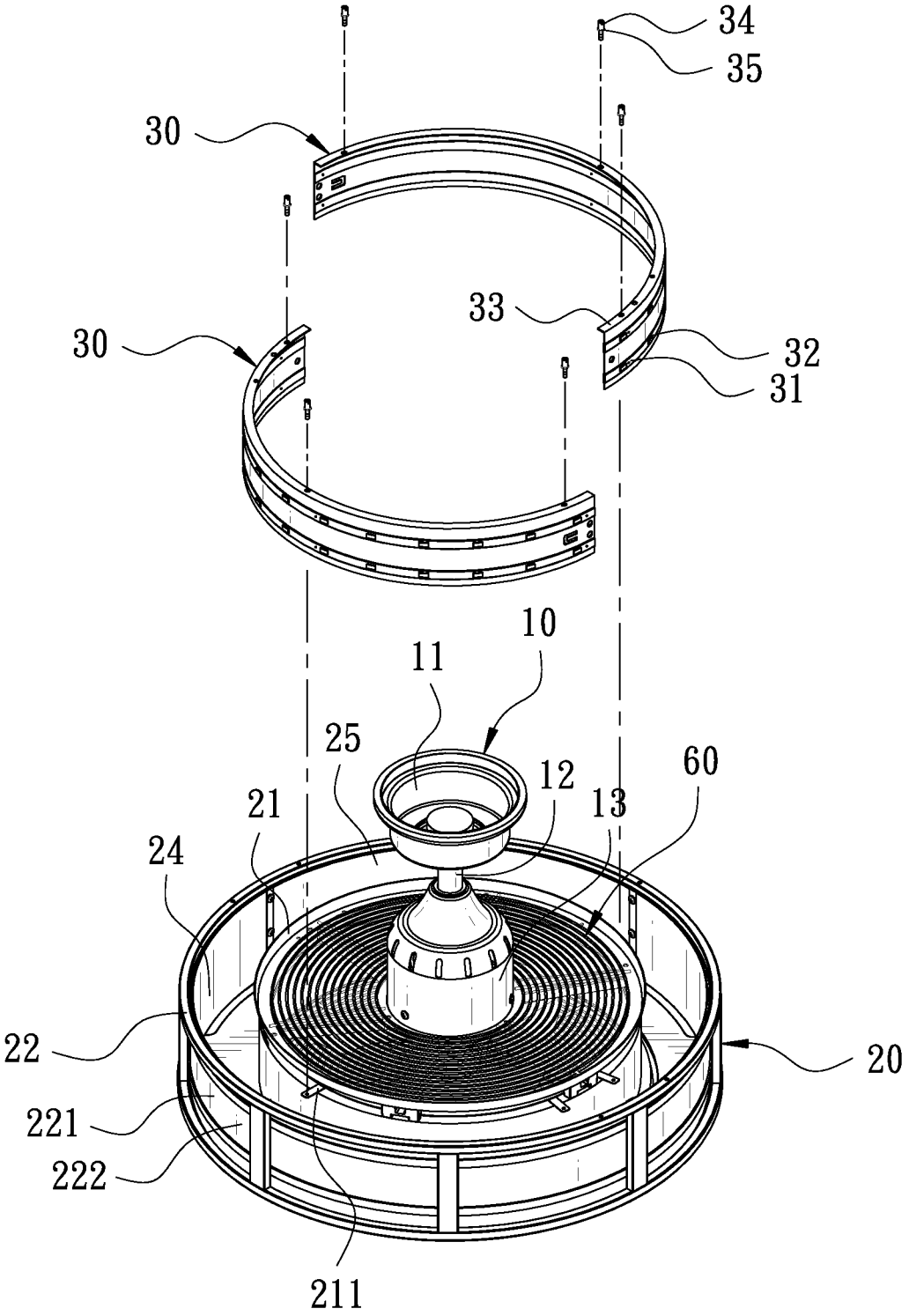
FIG. 7 is a second schematic view showing the disassembly of the preferred embodiment of the present invention.
Figure 8:
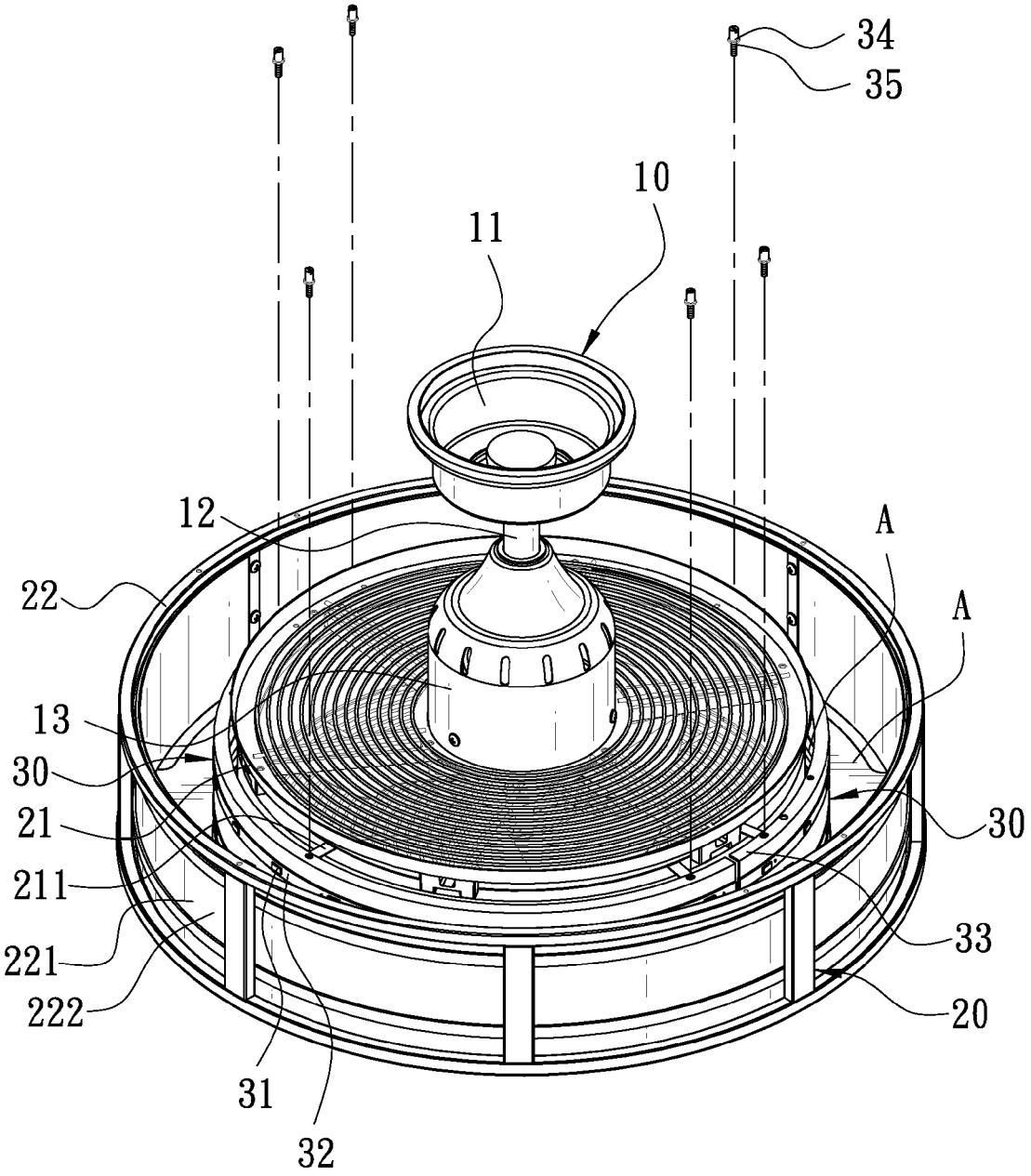
FIG. 8 is a third schematic view showing the disassembly of the preferred embodiment of the present invention.
Figure 9:
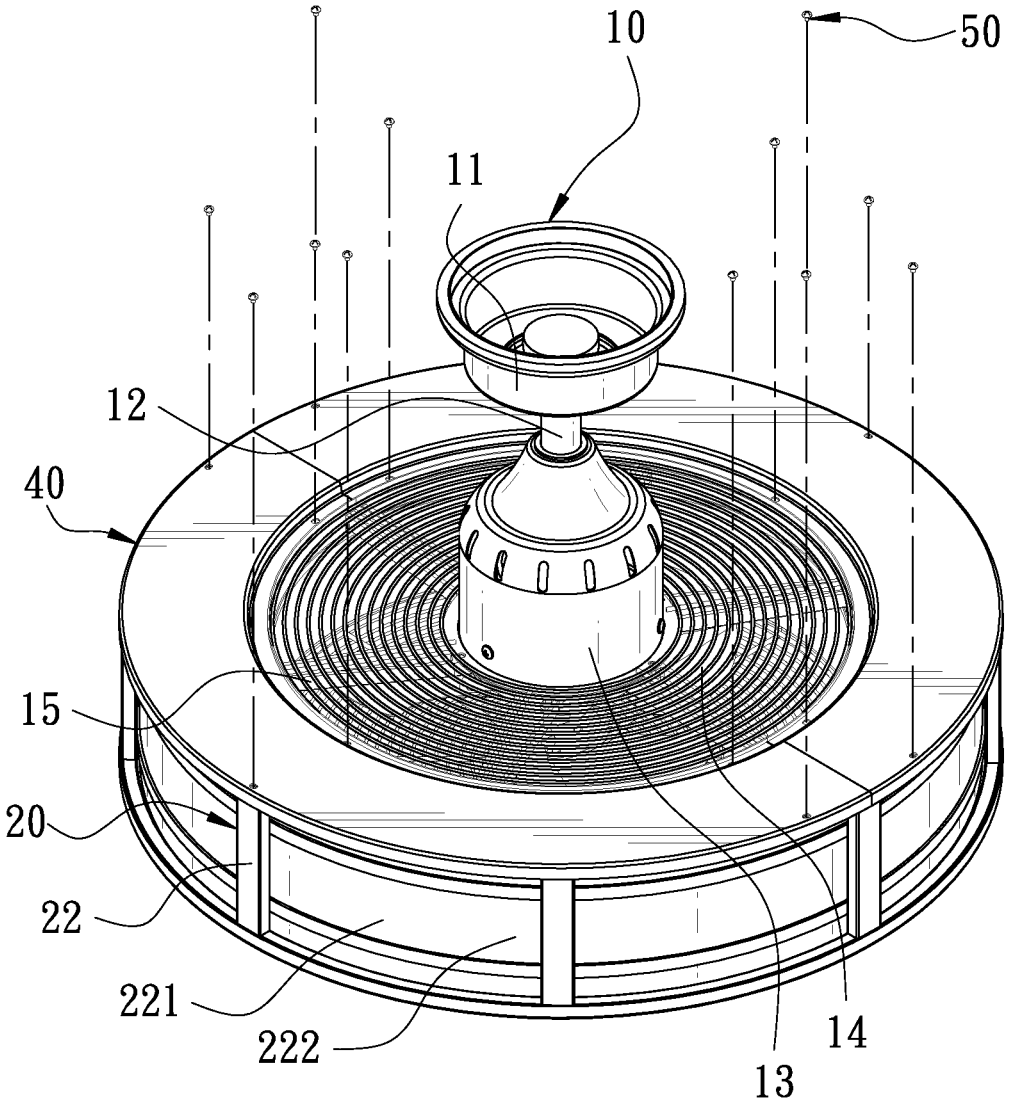
FIG. 9 is a fourth schematic view showing the disassembly of the preferred embodiment of the present invention.

FIG. 6 is a first schematic view showing the disassembly of the preferred embodiment of the present invention. FIG. 7 is a second schematic view showing the disassembly of the preferred embodiment of the present invention. FIG. 8 is a third schematic view showing the disassembly of the preferred embodiment of the present invention. FIG. 9 is a fourth schematic view showing the disassembly of the preferred embodiment of the present invention. In cooperation with FIG. 3 to FIG. 5, when the user wants to replace the LED lamp boards 30, the screws 50 to lock the lids 40 to the annular lampshade 20 are unscrewed, such that the lids 40 can be taken out from the opening 25. After that, the knurled-head screws 35 to lock the LED lamp boards 30 to the locking pieces 211 are unscrewed, such that the LED lamp boards 30 can be taken out for replacement. New LED lamp boards 30 are longitudinally disposed in the accommodation space 24 of the annular lampshade 20 to form a circle. The knurled-head screws 35 are adapted to lock the flanges 33 of the LED lamp boards 30 to the locking pieces 211 of the inner annular wall 21, such that the LED lamp boards 30 are assembled to the annular lampshade 20. The two opposing sides of the LED lamp board 30 keep the interval A relative to the inner annular wall 21 and the outer annular wall 22, respectively. Finally, the lids 40 are locked to the top of the annular lampshade 20 through the screws 50. In this way, the replacement of the LED lamp boards 30 is completed. Thereby, through the LED lamp boards 30 longitudinally disposed in the accommodation space 24 of the annular lampshade 20 as well as the lids 40 locked to the top of the annular lampshade 20, when in use, the locking parts won't be seen from the bottom of the annular lampshade 20. The present invention has the advantages of convenient replacement and pleasing appearance.

It is noted that the outer annular wall 22 is provided with the plurality of spaced first light-pervious through holes 221 and the inner side of the outer annular wall 22 is provided with the plurality of first light-pervious plates 222. The first light-pervious plates 222 are adapted to cover the first light-pervious through holes 221. The bottom wall 23 is provided with the plurality of spaced second light-pervious through holes 231. The inner side of the bottom wall 23 is provided with the plurality of second light-pervious plates 232. The second light-pervious plates 232 are adapted to cover the second light-pervious through holes 231. Through the first light-pervious plates 222 of the outer annular wall 22 and the second light-pervious plates 232 of the bottom wall 23, the circumferential wall and the bottom of the annular lampshade 20 have a light-pervious function. The present invention has a larger light-pervious area.

It is noted that the two opposing sides of the LED lamp board 30 keep the interval A relative to the inner annular wall 21 and the outer annular wall 22 respectively, enabling the LED strips 32 on the LED lamp board 30 to have enough space for radiating heat. The present invention has a better heat dissipation effect.

It is noted that the locking members 34 are knurled-head screws 35. The user can assemble or disassemble the LED lamp board 30 manually, without using a tool. It is simple and easy to replace the LED lamp board 30.

The ceiling fan structure of the present invention enables the LED lamp board 30 to have a better heat dissipation effect through the LED lamp board 30 longitudinally disposed in the accommodation space 24 of the annular lampshade 20 from the opening 25 as well as the lid 40 locked to the annular lampshade 20 from the top of the annular lampshade 20. When in use, the locking parts won't be seen from the bottom of the annular lampshade 20. The present invention has the advantages of convenient replacement and pleasing appearance.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ceiling fan structure with an LED (light emitting diode) lamp, comprising:

a ceiling fan main body having a hanging bracket, a lower end of the hanging bracket being connected with a hanging rod, a free end of the hanging rod being connected with a motor, a lower end of the motor being connected with a fan;

an annular lampshade having an inner annular wall around the periphery of the fan, an outer annular wall parallel to the inner annular wall, a bottom wall connected between the inner annular wall and the outer annular wall, an accommodation space defined among the inner annular wall, the outer annular wall and the bottom wall, and an opening formed on a top of the annular lampshade;

at least one LED lamp board longitudinally disposed in the accommodation space, the LED lamp board having a curved shape corresponding to the annular lampshade, two opposing sides of the LED lamp board keeping an interval relative to the inner annular wall and the outer annular wall respectively; and at least one lid disposed at the opening.

2. The ceiling fan structure as claimed in claim 1, comprising two LED lamp boards, the LED lamp boards each having a semi-circle shape to form a circle jointly.

3. The ceiling fan structure as claimed in claim 2, each of the LED lamp boards is provided with a plurality of light emitting diodes.

4. The ceiling fan structure as claimed in claim 1, wherein the outer annular wall is provided with a plurality of spaced first light-pervious through holes, an inner side of the outer annular wall is provided with a plurality of first light-pervious plates, and the first light-pervious plates are adapted to cover the first light-pervious through holes.

5. The ceiling fan structure as claimed in claim 1, wherein the bottom wall is provided with a plurality of spaced second light-pervious through holes, an inner side of the bottom wall is provided with a plurality of second light-pervious plates, and the second light-pervious plates are adapted to cover the second light-pervious through holes.

6. The ceiling fan structure as claimed in claim 1, wherein a circumferential side of the motor is provided with a plurality of connecting ribs extending radially, and another end of each of the connecting ribs is connected to the inner annular wall so that the annular lampshade is secured to the periphery of the fan.

7. The ceiling fan structure as claimed in claim 1, wherein a circumferential edge of the inner annular wall is provided with a plurality of locking pieces extending outwardly and transversely, a circumferential edge of the LED lamp board is provided with a flange extending transversely toward the inner annular wall, and each of the locking pieces is locked to the flange through a locking member so that the LED lamp board is secured to the annular lampshade.

8. The ceiling fan structure as claimed in claim 7, wherein the locking member is a knurled-head screw.

* * * * *